United States Patent [19]

Duckworth et al.

[11] 3,941,498

[45] Mar. 2, 1976

[54] VARIABLE GEOMETRY COLLECTOR FOR CENTRIFUGAL PUMP

[75] Inventors: Allen Duckworth, Glastonbury; Richard J. Hearn, New Hartford, both of Conn.

[73] Assignee: Chandler Evans Inc., West Hartford, Conn.

[22] Filed: Apr. 8, 1974

[21] Appl. No.: 458,567

[52] U.S. Cl. ..... 415/46; 60/39.28 R; 415/150; 417/279

[51] Int. Cl.[2] ..... F04D 15/00

[58] Field of Search ..... 415/46, 150, 151, 158; 417/279; 60/39.28 R

[56] References Cited

UNITED STATES PATENTS

| | | | |
|---|---|---|---|
| 2,861,774 | 11/1958 | Buchi | 415/150 |
| 2,956,576 | 10/1960 | McKeggie | 60/39.28 R X |
| 2,970,437 | 2/1961 | Anderson | 60/39.28 R X |
| 2,989,849 | 6/1961 | Torell et al. | 60/39.28 R X |
| 3,032,259 | 2/1962 | Jassniker | 415/148 |
| 3,236,500 | 2/1966 | Kofink | 415/150 |
| 3,265,000 | 8/1966 | Tyler et al. | 415/150 |
| 3,447,470 | 6/1969 | Bottoms et al. | 415/150 |
| 3,478,955 | 11/1969 | Kunderman | 415/158 |

FOREIGN PATENTS OR APPLICATIONS

| | | | |
|---|---|---|---|
| 252,084 | 5/1970 | U.S.S.R. | 415/158 |
| 753,316 | 7/1956 | United Kingdom | 415/158 |
| 1,142,112 | 9/1957 | France | 415/159 |
| 1,206,943 | 9/1970 | United Kingdom | 415/158 |
| 1,471,434 | 1/1967 | France | 415/158 |
| 1,451,895 | 7/1969 | Germany | 415/150 |

*Primary Examiner*—C. J. Husar
*Assistant Examiner*—Edward Look
*Attorney, Agent, or Firm*—Radford W. Luther; Richard A. Dornon

[57] ABSTRACT

A centrifugal type impeller pump has a restricting valve to control the inlet area of the collector for reducing recirculating flow from the collector to the impeller. The restricting valve includes a ring mounted upon the pump housing for rotary and axial motion. Rotary motion is imparted to the ring by an actuator. Cam slots in the ring and pins secured to the housing produce axial motion of the ring as the ring rotates. Precise positioning of the ring is possible because large motions of the actuator can be utilized to provide small changes in ring position. The axial position of the ring is determinative of the inlet area of the collector.

5 Claims, 5 Drawing Figures

2
12
16
18
14
3
3
50
52
44
42
8
10b
48
34
38a
40
38
32
36
10a
26
24
28
10
20
30
29
46
44a
22
10c
2

16
76
44
78
72
70
74
20
68
66
12
58
56
64
54
62
60

VARIABLE GEOMETRY COLLECTOR FOR CENTRIFUGAL PUMP

BACKGROUND OF THE INVENTION

This invention relates to fluid pumps and more particularly to a centrifugal type of fluid pump. The invention also relates to fuel controls for gas turbine engines.

A problem with centrifugal impeller pumps, which operate during low flows, is the recirculation of flow from the collector thereof back into the impeller section. This flow recirculation contributes significantly to a reduction in pump efficiency and increases undesirable heating of the fluid being pumped.

Prior art devices which restrict the impeller discharge area or collector inlet area have demonstrated that a reduction in recirculating flow engenders a noticeable improvement in pump efficiency. However, the available mechanical systems in the prior art for controlling the inlet area on the collector do not allow for precise positioning of the valve which dictates the inlet area. Hence, the mechanical systems of the prior art which are employed to regulate the collector inlet area have not been adapted for the precise control to render them suitable for certain applications, such as aircraft applications.

SUMMARY OF THE INVENTION

The invention is directed to a restricting valve for the inlet of the collector of a centrifugal type pump. A restricting valve of the invention is adapted to be precisely positioned so that a pump incorporating the restricting valve may be suitably employed in applications having the aforementioned requirements.

A pump of the invention comprises a restricting valve in the form of a ring mounted on the pump housing such that rotation of the ring controls the inlet area of the collector. Rotary motion of the ring is produced by a suitable actuator (such as an electric or fluid motor); and axial motion of the ring, which affects either a reduction or an enlargement of the inlet area of the collector, is beget by a cam means which imparts a small axial motion to the ring for a larger rotary motion in thereof. In a preferred embodiment of the invention slots in the ring receive pins which are fixedly secured to the housing such that rotary motion of the ring produces a corresponding axial movement of the ring. In yet another preferred embodiment to the invention, the ring may serve not only to restrict the collector inlet area but also to reduce the volume of the collector itself.

Accordingly, it is a primary object of the invention to provide a centrifugal type impeller pump with a restricting valve for the inlet area of the collector wherein the valve is capable of being precisely positioned.

This and other objects and advantages of the invention will become more readily apparent from the following detailed description, when taken in conjunction with the accompanying drawings, in which:

DETAILED DESCRIPTION OF PREFERRED EMBODIMENTS

Figure 1:
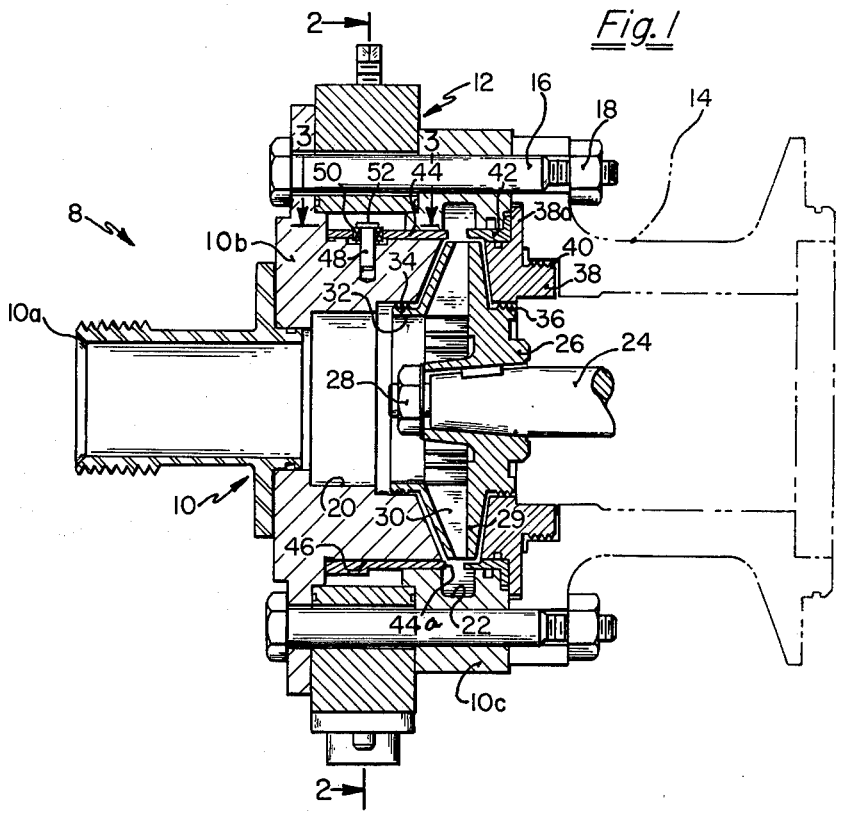
FIG. 1 is a side elevational view, in cross section, of a centrifugal type impeller pump of the invention.

Referring to FIG. 1, there is shown a centrifugal type impeller pump 8 of the invention having an impeller housing 10, an actuator housing 12 and a bearing housing 14, the latter being depicted in phantom. The various housings are complimentary sections which together form the pump body. A plurality of bolts 16 extend through passages in their respective housings to engage nuts 18 for maintaining the assembled relationship. The impeller housing 10 is constituted by an inlet section 10a, a main section 10b having an impeller chamber 20 formed therein, and a peripheral section 10c in which is defined a peripheral manifold or collector 22 which receives the impeller fluid.

A rotatable shaft 24 is mounted in concentric relationship to the impeller chamber 20 and carries upon its end an impeller 26 securely mounted thereupon in the conventional manner by an impeller nut 28. The impeller 26, which is of a well known type, comprises a web section 29 with radially extending vanes 30 fashioned thereupon. The impeller 26 also includes the usual suction eye 32 which lies radially inwardly of the vanes. In addition, the impeller 26 carries labyrinth seals to furnish a pressure breakdown means to minimize leakage through the running clearance which must necessarily be provided between the impeller and the impeller housing, the labyrinth seals being designated 34 and 36. A sealing element 38 comprises threads 40 on the rear portion thereof so that it may be secured in threaded engagement to the bearing housing 14 with its interior periphery engaging the labyrinth seal 36. A flange **38*a* on the sealing element 38, together with an intermediate cylindrical surface of the sealing element 38, functions to position a cylindrical valve seat 42 adjacent the inlet of the collector 22**.

Figure 2:
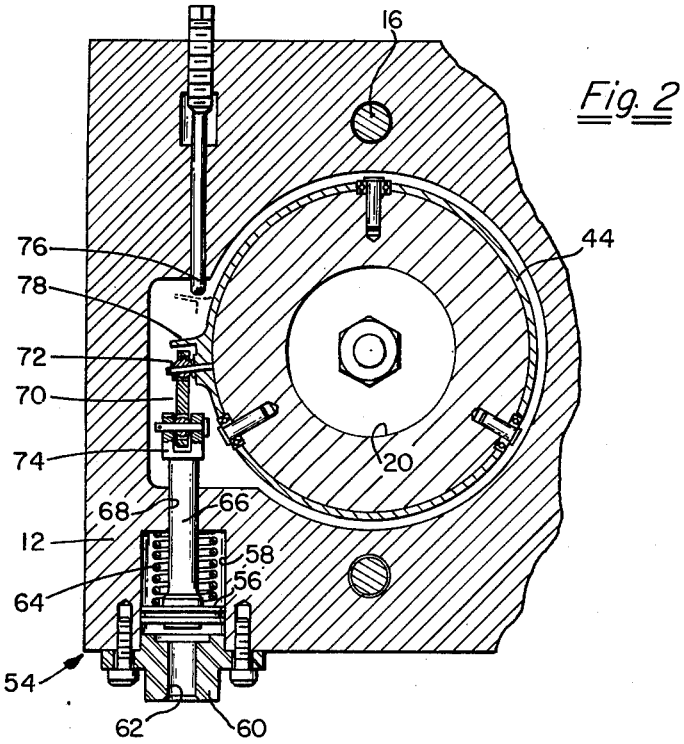
FIG. 2 is a sectional view of the pump of FIG. 1 taken along the line 2—2 of FIG. 1.
Figure 3:
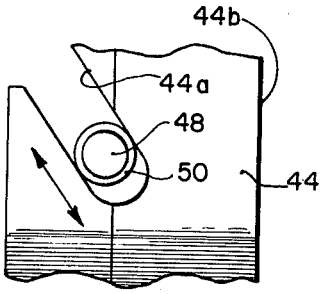
FIG. 3 is a view taken along the line 3—3 of FIG. 1 showing the engagement between the ring and a pin.

As best shown in FIGS. 1 through 3, the restricting valve of the invention is constituted by a cylindrical sleeve or ring 44 mounted upon a portion 46 of the outside surface of the section 10b of the impeller housing 10 in coaxial relationship with the impeller housing and the impeller 26. The portion 46 of the outside surface of the impeller housing 10 serves as a bearing and a guide for the rotational and axial movement of the ring 44. As is shown in FIG. 3, the ring 44 comprises three helical slots **44*a* which are spaced in an equidistant manner around the ring 44. Three pins 48 are fixedly connected to the main section 10b of the impeller housing 10 and are spaced in an equidistant manner around the impeller housing so as to define angles of 120 degrees therebetween. A bearing 50 surrounds each pin 48 beneath an upper flange 22 (FIG. 1) integral with the pin to thereby define a roller which is received in the slot 44a. The rear face 44b of the ring 44 is in confronting relationship to the valve seat 42 such that the spacing therebetween is determinative of the inlet area of the collector 22**.

Rotation of the ring 44 relative to the impeller housing 10 in a clockwise direction as viewed from the inlet results in a progressive reduction in the inlet area of the collector 22 and conversely a rotation of the ring 44 in a counterclockwise direction affects a progressive increase in the inlet area of the collector 22. It will be noted that the portion 46 of the outer surface of the impeller housing performs the combined functions of acting as a cylindrical guide member for axial movement of the ring 44 as well as serving as a bearing for supporting the ring 44 during rotation thereof.

A preferred actuator for rotating the ring 44 is illustrated in FIG. 2 under the general designation 54. The actuator 54 comprises a piston 56 mounted for axial sliding movement within a bore 58 in the actuator housing 12. The mouth of the bore 58 is covered by a plug 60 having a conduit 62 for the admittance of a control pressure generated by an appropriate control device. A spring 64 functions to bias the piston 56 to the left wherein the inlet area of the collector 22 is at a maximum value. Attached to the right side of the piston 56 in concentric relationship thereto is a shaft 66 which is slideably mounted within a smaller bore 68 in the actuator housing 12. A link 70, having universal couplings 72 and 74 at its ends, interconnects the end of the shaft 66 with the ring 44 such that axial movement of the piston 56 and the shaft 66 imparts rotary motion to the ring 44. An adjustable stop abuttment 76 is arranged within the actuator housing 12 to contact a radial projection 78 integral with the ring 44 to limit the minimum size of the inlet area when a control pressure is applied to the underside of the piston 56, which is not balanced by the opposite force exerted by the spring 64.

Figure 4:
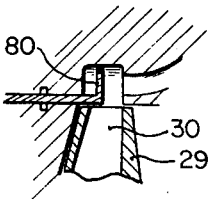
FIG. 4 depicts an alternative form of ring which restricts not only the collector inlet area but also the collector volume.

FIG. 4 shows an alternative version of the ring which controls the inlet area of the collector. In this modification the ring includes a flange 80 having a sliding seal on its upper edge whereby the ring may not only control the inlet area to the collector but also the collector volume itself. This is advantageous because the recirculation of flow within the collector is reduced, and thereby the frictional loss in the fluid is also reduced, and the efficiency of the pump is increased.

Figure 5:
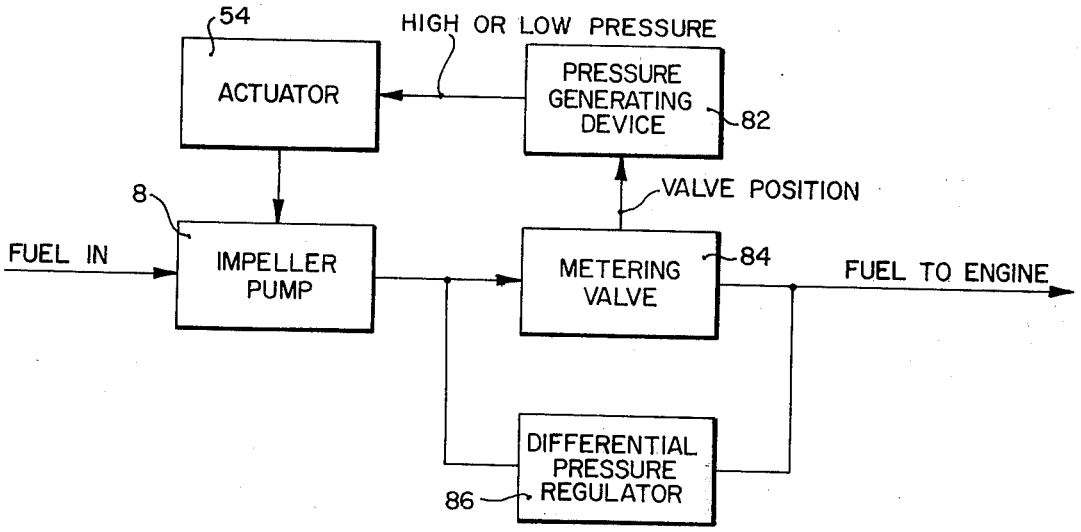
FIG. 5 is a block diagram depicting a pump of the invention incorporated in a fuel control system for a gas turbine engine.

A fuel control application, for which the pump of the invention is particularly well suited, is outlined in FIG. 5. For the purposes of describing the operation of the illustrated pump, assume that the pump is adapted to supply fuel to a gas turbine engine of an aircraft and hence constitutes a part of a fuel control therefor. A gas turbine engine, which is operated at a high altitude, has far lower fuel flow requirements than at sea level. When the fuel flow rate falls below a predetermined level at which recirculation problems are encountered in the pump, a pressure generating device, which may assume many forms, increases the pressure applied to the lower face of the piston 56. Assuming that the engine has a fuel control in which a constant head is always maintained across a metering valve 84 (which is in series flow relationship with the impeller pump 8) by a pressure regulator 86, the position of the metering valve 84 may be utilized to control the pressure generating device 82 since valve position is an indication of the flow to the engine and hence the flow through the pump. Typical metering valves and pressure regulators are shown in FIG. 1B of U.S. Pat. No. 3614269. The increase in pressure in the lower face of the piston 56 is sufficient to cause the piston to be driven against the bias of the spring 64 until the projection 78 contacts the abuttment 76. During the stroke of the piston 56 the ring 44 rotates and simultaneously moves in an axial direction towards the seat 42. When the projection 78 establishes contact with the abuttment 76, the inlet area of the collector 22 will have been reduced to a predetermined extent whereby recirculation in the impeller cavity is ameliorated. As long as flow through the pump remains below the predetermined level, pressure is continuously applied to the lower face of piston 56, thereby to maintain the projection 78 in contact with the abuttment 76. However, when the flow to the pump exceeds the predetermined level, the pressure generating device 82 relieves the pressure on the lower face of piston 56, thereby permitting the spring 64 to force the piston back to its original position wherein the inlet area of the collector is at its maximum value. During the return stroke of piston 56, the ring 44, of course, rotates in the opposite direction and the face 44*a* withdraws from the valve seat 42.

It should be noted that certain applications may make it necessary for the ring 44 to be capable of assuming a plurality of intermediate positions in which the inlet area of the collector (or collector volume) is somewhere between its maximum and minimum values. In such a situation, a proportional position control system may be utilized in such a manner that the ring position is a linear (or non-linear) function of the flow rate whereby the ring may be continuously positioned as the sensed flow rate varies. Moreover, other ring positioning schemes are also within the ambit of the invention.

Obviously, many variations and modifications are possible in light of the above teachings without departing from the invention as defined in the claims.

We claim:

1. In an impeller-type pumping arrangement, the combination comprising:

a housing having an impeller chamber and a collector with an inlet encircling the impeller chamber;

an impeller mounted for rotation within the impeller chamber for forcing fluid into the collector via the inlet thereof;

a ring mounted upon the housing in coaxial relationship to the impeller for rotation and for axial movement toward and away from the collector such that the inlet area of the collector is respectively reduced and increased;

cam means responsive to rotation of the ring to axially move the ring such that the inlet area is reduced and increased in accordance with the sense of rotation of the ring;

an actuator responsive to a control signal operatively connected to the ring for rotating the ring to reduce the inlet area of the collector for low flow rates;

a metering means in fluid connection with the collector for regulating the rate of flow therethrough irrespective of the inlet area of the collector as determined by the position of the ring;

means responsive to the rate of flow through said metering means to generate a rate of flow signal indicative of the flow through the impeller chamber and the collector; and means responsive to the rate of flow signal to generate the control signal for the actuator when the rate of flow falls below a predetermined level.

2. The combination of claim 1, wherein the cam means comprises:

a slot in the ring; and a pin fixedly secured to housing and received in the slot such that the pin axially displaces the ring during rotation thereof.

3. The combination of claim 2, wherein the actuator comprises:

a piston;

a shaft connected to the piston;

a link;

a first universal coupling interconnecting the link and the shaft; and a second universal coupling interconnecting the link and the ring.

4. The combination of claim 1, further including:

means to stop the rotation of the ring to define a predetermined minimum inlet area.

5. The combination of claim 1, wherein the ring comprises:

a flange thereupon extending into the collector such that movement of the ring also controls the collector volume.

* * * * *